US005933887A

United States Patent [19]

Strange et al.

[11] Patent Number: 5,933,887

[45] Date of Patent: Aug. 10, 1999

[54] SURGICAL SUPPORT SYSTEM INCLUDING PATIENT SUPPORTING SEAT

[76] Inventors: Paul S. Strange, 543 N. Audubon, Indianapolis, Ind. 46219; Cynthia P. Ruegg, 4039 Lucky Ln., Greenwood, Ind. 46142

[21] Appl. No.: 09/013,905

[22] Filed: Jan. 27, 1998

[51] Int. Cl.[6] ..... A61G 13/04; A61G 12/12

[52] U.S. Cl. ..... 5/600; 5/632; 5/610; 5/624; 297/195.11; 128/845

[58] Field of Search ..... 5/600, 610, 621, 5/624, 630, 632, 648, 602, 604, 618; 297/195.1, 195.11; 128/845

[56] References Cited

U.S. PATENT DOCUMENTS

| | | | |
|---|---|---|---|
| D. 164,048 | 7/1951 | McClure et al. . | |
| D. 245,287 | 8/1977 | Damico et al. . | |
| D. 322,855 | 12/1991 | Tabuchi . | |
| D. 357,538 | 4/1995 | Sockwell et al. . | |
| D. 378,613 | 3/1997 | Sundstrom . | |
| 2,872,259 | 2/1959 | Thorpe . | |
| 3,046,072 | 7/1962 | Douglass, Jr. et al. | 5/623 X |
| 3,188,079 | 6/1965 | Boetcker et al. . | |
| 3,599,962 | 8/1971 | Henry . | |
| 3,655,179 | 4/1972 | Lelugas | 5/618 |
| 3,975,051 | 8/1976 | Ballagh . | |
| 4,552,404 | 11/1985 | Congleton . | |
| 4,940,218 | 7/1990 | Akcelrod | 5/624 X |
| 5,168,514 | 12/1992 | Horton, Jr. et al. . | |
| 5,444,882 | 8/1995 | Andrews et al. | 5/624 X |
| 5,535,459 | 7/1996 | DiMatteo et al. | 5/600 X |
| 5,647,639 | 7/1997 | Wiggins . | |

*Primary Examiner*—Michael F. Trettel
*Attorney, Agent, or Firm*—Antonelli, Terry, Stout & Kraus, LLP

[57] ABSTRACT

A seat is adjustably mounted immediately forwardly of the front end of an adjustably inclinable patient support table. A patient whose back and head are supported on the inclined table is positioned so that the seat has a rear portion adjacent a front of the table to support the patient under the buttocks, so that the patient's epigastric region is frontally accessible by a doctor positioned in front of the patient.

17 Claims, 5 Drawing Sheets

SURGICAL SUPPORT SYSTEM INCLUDING PATIENT SUPPORTING SEAT

FIELD OF THE INVENTION

This invention relates to supporting a patient in an inclined position to facilitate surgical frontal access to the patient's upper abdomen. More particularly, this invention relates to an apparatus including an inclined table and a cooperating seat for comfortably positioning a patient in an infinitely adjustable manner to facilitate frontal access by a doctor/surgeon to the patient's upper epigastric/abdominal region.

BACKGROUND OF THE RELATED INVENTION

There are several surgical situations in which a patient, who is to undergo a surgical procedure on the organs and structures in the upper abdomen, must be supported in an inclined position in such a manner that a doctor while in front of the patient has optimum access to the patient's upper abdominal region. For example, such support is required to permit optimum frontal exposure of a patient's epigastric region for a surgeon to perform laparoscopic procedures with the patient under general anesthesia. When the back of such a patient is inclined relative to the local horizontal by adjustment of a known tilting support table, there is a natural tendency for the patient to slide forwardly and downwardly toward the front of the inclined table.

Typically, in frontal surgical procedures involving the epigastric area/region, the patient's legs are somewhat bent at the knees and are individually supported in a lithotomy position with adjustable stirrups. This position, coupled with the paralyzing effects of general anesthesia and the downward gravitational draw along the surgical table causes the patient to be unstably supported. Without a more secure means, and depending on size, weight and general physical condition, the patient will probably end up in an uncomfortable position and the attending doctor also will have difficulty in performing the intended examination/treatment. In addition, since the patients are surgical pateints and will be anesthetized, there is a danger of the patient sliding completely off the operating table.

One known solution to this problem is for the patient to be initially laid supine on the table in an essentially horizontally position, and for a flexible bag filled with Styrofoam pellets to be placed under the patient's posterior with the legs bent relative to the patient's trunk. The bag is then adhesively taped to the table surface. In one variation of this technique, suction may be applied to the interior of the bag to extract air and cause the Styrofoam pellets to become compacted immediately adjacent to the patient's pelvis. The patient's legs are then supported on individual stirrups in known manner and the table, with stirrups attached, is thereafter controllably inclined to the horizontal so that part of the patient's weight is supported by the Styrofoam-filled flexible bag (with or without applied suction). The flexible bag itself is prevented from sliding relative to the inclined table surface by the tape adhering to both the flexible bag and the inclined table. This technique is relatively simple and provides customized support to the patient in a manner which at least partially limits the patient's tendency to slide relative to the inclined table support surface. Unfortunately, the Styrofoam-filled bag, in order to be at all effective, tends to be of a size and shape which at least somewhat impedes a doctor's access to the patient and is unpredictable in providing secure support when the patient is at an optimum inclination.

There are also other circumstances when a patient needs part of his or her body held in position by a support element located underneath the pelvis.

U.S. Pat. No. 3,599,962, to Henry, titled "Orthopedics Cast Chair", discloses an adjustable chair apparatus for supporting a person in a position which permits bandaging and casting of various parts of the body, particularly the lower extremities and torso. The apparatus includes a bicycle-type saddle seat adjustably mounted on a supporting frame so as to maintain the patient in a sitting position. The patient's legs are suspended and the patient's trunk is maintained substantially upright, without support members adjacent the patient's lower extremities, so that the legs may be freely operated upon.

U.S. Design Pat. No. 357,538, to Sockwell, II et al, titled "Board for Supporting Pregnant Women", discloses an ornamental design for a board for supporting pregnant women. The design includes an inclined table and a seat apparently supported at the distal end of a substantially horizontal rod or tube extended through an opening in the inclined support surface. This being a design application, it is difficult to determine the exact manner of its use in practice, but it is apparent that the user would sit facing the board on the seat having its narrow front end closest to the board surface.

U.S. Design Pat. No. 245,287, to Damico et al, titled "Examination Table", teaches an apparatus which includes a patient-support table portion in two parts inclinable relative to each other. Support underneath the patient's pelvic region is provided by a portion of the two-part inclinable table support surface.

U.S. Pat. No. 5,168,514, to Horton, Jr. et al, titled "Modular Radiotherapy Treatment Chair and Methods of Treatment", teaches a chair arrangement with a saddle-like seat for unobstructively supporting a patient in a "straddled stance" to allow therapeutic radiation to be applied to the lower abdominal and pelvic regions. Because such patients would find it difficult to lie flat during treatment, the seat portion is substantially surrounded by a tubular structure and the patient sits with his or her trunk upright.

As is evident from the above-discussed exemplary references, the use of a saddle-like seat to provide support to a patient undergoing examination/treatment is known for certain applications. However, such known solutions do not fully satisfy the need of patients who are best accessed/treated by doctors when the patient is supported with the trunk in an inclined position and with the patient's legs supported in a spread-out disposition so that the doctor has optimum unimpeded frontal access to the patient's upper abdominal region. There is, thus, an existing need for an infinitely adjustable system which enables a doctor to quickly customize the support required by a particular patient and to infinitely adjust the support as needed for optimum frontal pelvic access to the patient. The present invention is intended to meet this long-felt need.

SUMMARY OF THE INVENTION

A principal object of this invention is to provide an apparatus by which a patient may be supported in an inclined lithotomy position so as to facilitate frontal access to the patient's upper abdominal, i.e., epigastric, region by a surgeon.

Another object of this invention is to provide support for a patient so that the patient's upper body is in a selected inclined position relative to the horizontal, the patient's legs are individually supported adjustably, and upward support is provided beneath the patient's buttocks.

It is a further object of this invention to provide an improved apparatus comprising an inclinable patient-support table portion and an infinitely-adjustable saddle-like seat element cooperating with the inclined support table to securely position a patient in a manner permitting optimum frontal access to the patient's upper abdomen, i.e., the epigastric region.

In yet another aspect of this invention there is provided a method of supporting a patient resting in part on an adjustably inclined support surface in a manner which permits optimum viewing of and frontal access to the patient's upper abdomen, i.e., epigastric region.

These and other related objects of this invention are realized in a first embodiment thereof by providing an apparatus for supporting a patient in an inclined position, which includes a base and a support table mounted to the base so as to be adjustable at least vertically and about a first axis of rotation relative to the base, for supporting at least the head and back of the patient. A seat having a rear end portion is disposed adjacent a front end of the support table with a front portion of the seat disposed forwardly. The seat is supported to the base so as to be selectively adjustable independently of the support table. The seat is adjustable horizontally, laterally and vertically, and rotationally at least about a second axis of rotation relative to the base, so that the rear end portion of the seat extends beneath and supports the patient's buttocks when the support table is inclined.

In another aspect of the invention, there is provided an improved surgical support system for supporting a patient in an adjustably inclined position above a base, with the patient's torso and head supported on an inclinable table supported at a selected height above the base. The improvement comprises a seat supported to the base and having a rear end portion disposed adjacent a front end of the table to support the patient's buttocks. The seat is adjustable with three degrees of ranslation and rotatably about at least one axis relative to the base.

In yet another aspect of the invention there is provided a method of supporting a patient so as to facilitate frontal access by a doctor to the epigastric region of the patient. The method includes the steps of placing the patient on an inclinable table extending beneath and contacting the back of the patient, inclining the table, and providing and adjusting a seat to support the patient's buttocks in cooperation with the inclined table.

DETAILED DESCRIPTION OF THE PREFERRED EMBODIMENTS

Figure 1:
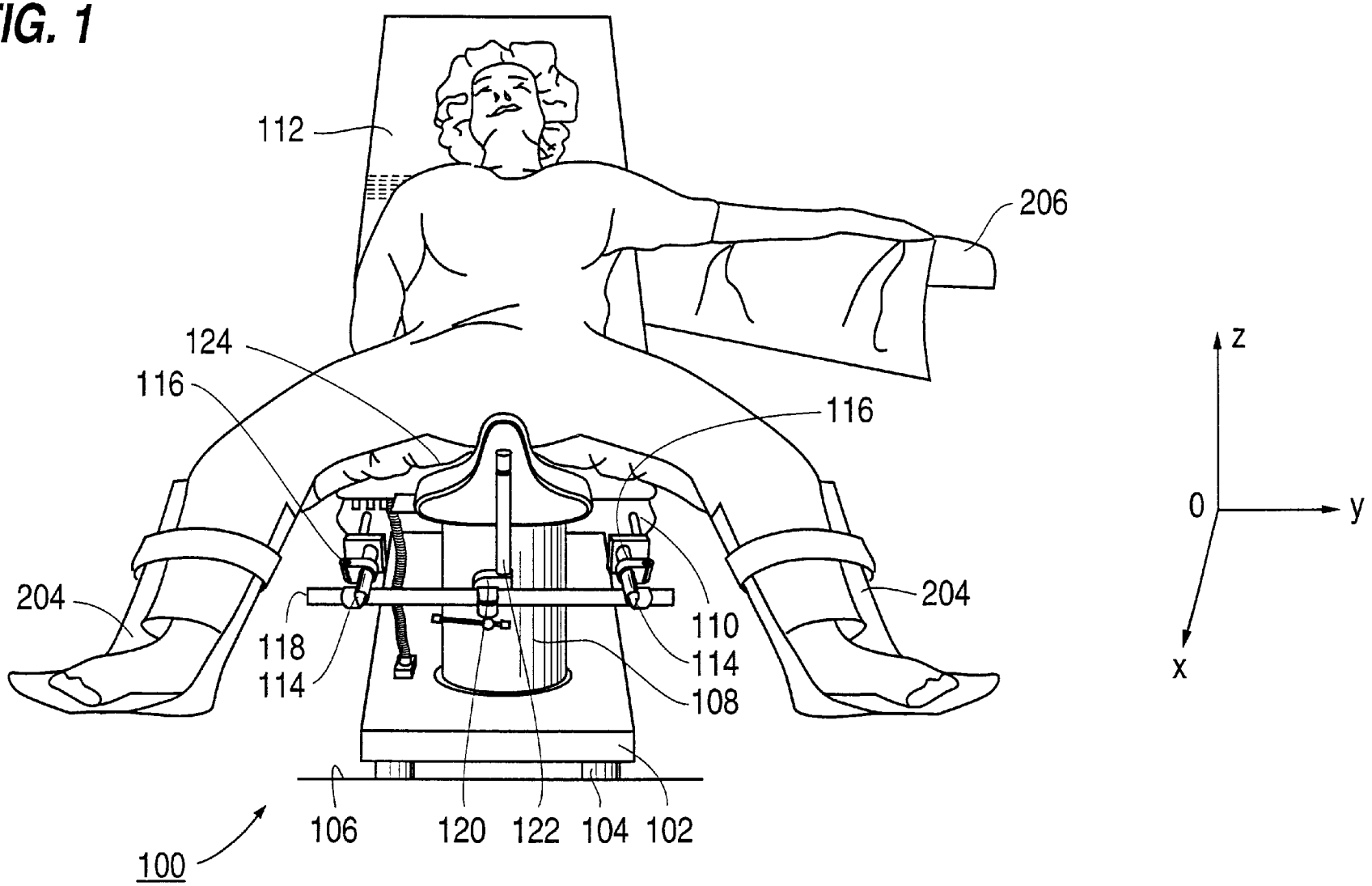
FIG. 1 is a front perspective view of a patient positioned on a support system according to a first embodiment of this invention, wherein the patient's legs are supported in individual adjustable stirrups and at least one of the patient's arms is also supported to a side.

In the first preferred embodiment of this invention, as best seen in FIG. 1, patient support apparatus 100 includes certain known elements. These include a conventional lower support base or platform 102 which may be mounted on a plurality of feet 104 resting on an operating room floor 106. The feet 104 may be adjustable in height, may include casters, and may be electrically insulated or grounded to the floor, as judged most suitable for particular applications. Such variations are known, and the details thereof are therefore not considered critical to the present invention.

On the lower support base 102 may be mounted a cylindrical, upright, intermediate post 108 which may be hollow and may slidingly accommodate a piston (not shown) which may be hydraulically driven in known manner to adjust the vertical height of various elements supported thereabove. The supported elements in this embodiment typically would include an upper table portion 110 preferably supported to be vertically movable and pivotable about a horizontal axis at its front end. Upon table portion 110 will usually be provided a resilient pad 112 which may have a removable sterile cover. The thickness, width and length of pad 112 are matters of design choice, but typically will be selected to ensure comfortable support for major body portions of a patient along the spine, shoulders and head. Other elements may be included to suit particular needs of the patient and/or the attending doctors or nurses, e.g., shaped pillows to limit the motion of the head, etc., and the details thereof are not considered critical to the present invention.

Table portion 110 may also be provided with a pair of parallel cylindrical support rods 114, 114 which may have tapered or rounded front distal ends. One system with such a feature is commercially sold under the name "Skytron". The support rods 114, 114 in this embodiment may optionally be mounted relative to support base 102 so that they remain horizontal at all times and do not tilt or pivot when the table portion 110 immediately beneath pad 112 is pivoted about a horizontal axis near its front. The key purpose in providing the parallel support rods 114, 114 is to enable mounting thereon of slidable clamps 116, 116 which cooperatively support a horizontal crossbar 118.

Crossbar 118, in its turn, slidably supports seat-clamp 120 which also supports a seat post 122 to the upper end of which is mounted a preferably saddle-like seat 124 of suitable shape and size, e.g., one generally similar to the seat of a conventional bicycle. In this manner, seat 124 is strongly held just forwardly of the front end of pad 112 and is infinitely adjustable with six degrees of freedom, as explained below.

As discussed earlier, the lower support base 102 of the overall known support structure rests on and close to floor 106 and is preferably horizontal. Hollow cylindrical post 108 mounted thereon, by hydraulic, mechanical or electrical means of known kind, provides vertical adjustment to all other elements mounted thereabove. Such elements, including in particular the pivotably disposed pad 112 and seat 124, are thus all permitted translational movement along a vertical axis, e.g., axis Oz in the reference triad provided as part of FIG. 1. By loosening clamps 116, 116, a user, e.g., the surgeon or nurse, may move crossbar 118 and seat 124 supported thereon longitudinally along support bars 114, 114, thereby providing a translational motion in a second direction, i.e., along axis Ox in a direction perpendicular to vertical axis Oz. Furthermore, by loosening appropriate portions of clamps 116, 116, a user can move crossbar 118 and seat 124 supported thereon in a third horizontal direction, i.e., along axis Oy in a direction perpendicular to both the vertical direction and support bars 114, 114. This provides the third degree of translational freedom of adjustment of seat 124. Two or more degrees of translational freedom, and possibly one or more rotational degrees of freedom may be involved in different adjustments.

Note that additional vertical adjustment along axis Oz, and additional horizontal translational movement along axis Oy are both permitted by suitable adjustment of clamp 120 by which seat post 122 is mounted to crossbar 118.

As will be readily apparent, rotation about vertical axis Oz can be readily obtained between vertical support post 108 and all the other elements which are hydraulically, mechanically or electrically adjustably supported thereover. In other words, the entire patient-contacting structure can be rotated about the vertical axis in conventional manner. This would inherently provide seat 124 with a first degree of rotational freedom about vertical axis Oz. In addition, by loosening of clamps 116, 116 a user could obtain rotation of transverse support rod 118 about axis Oy, thus providing a second rotational degree of freedom to crossbar 118 and seat 124 supported thereon. Furthermore, by loosening clamp 120 a user could obtain rotation with the same rotational degree of freedom about axis Oy and a rotation of seat post 122 about axis Oz.

Finally, by using a conventional seat-mounting mechanism, i.e., of the type normally found on conventional bicycles, seat 124 itself can be rotatably adjusted relative to seat post 122 where the two are connected to each other. In fact, if a conventional ball-clamp mechanism is used to mount seat 124 at the upper distal end of seat post 122, using conventional and commercially-available elements, seat 124 can be provided three rotational degrees of freedom to complement the other rotational motions possible as described above.

In summary, seat 124 can be moved up-and-down, forward-and-back, and side-to-side, and can be tipped or rotated just about any way the user determines is most useful to support a particular patient for a particular treatment.

Figure 2:
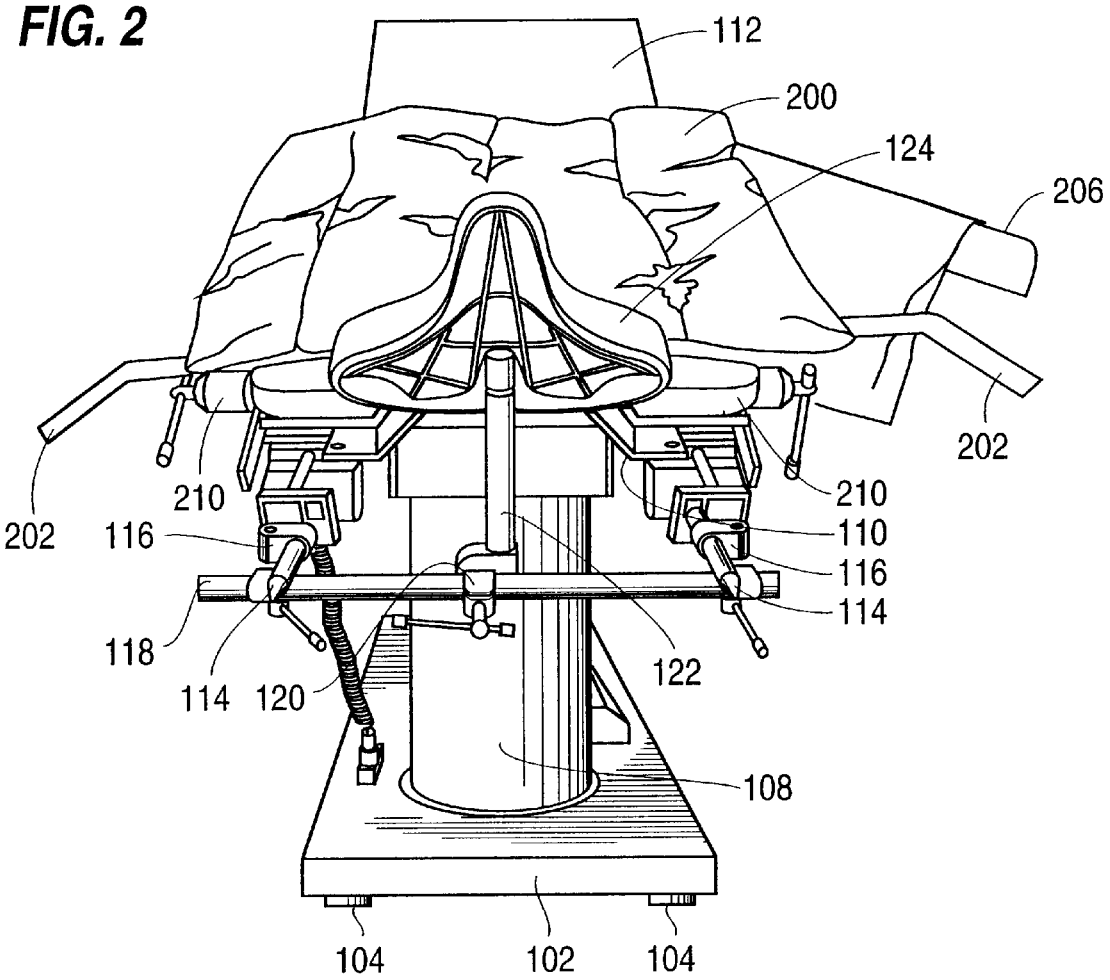
FIG. 2 is a front perspective view of the principal patient-supporting elements of the apparatus per FIG. 1, with portions of the leg-supporting stirrup elements omitted.

FIG. 2 shows most of the key components of the first preferred embodiment per FIG. 1, and enables viewing of an underlying optional flexible sterile cover 200 which may be put on pad 112 before placement of a patient thereon. FIG. 2 also more clearly shows two stirrup-support mounts 202, 202 to the lower distal ends of which may be mounted conventional patient-supporting stirrups 204, 204 (best seen in FIG. 1). Also more clearly seen in FIG. 2 is an exemplary optional patient arm support 206.

As is readily seen in both FIGS. 1 and 2, each of the clamps, e.g., 116 and 118, may be tightened in place by threaded elements and conventional cranking arms (not numbered). Other alternatives, such as winged elements, etc., may be employed instead, and the exact physical form of such tightening elements is not considered critical to the present invention.

Additionally, small electric motors, hydraulic pistons and the like (not shown), of any known kind, may be included as appropriate to facilitate various motions of the different elements to obtain the desired pivoting, raising, translational movement, etc. Such options, while they may add to the total cost of the system, may make the user's task easier and may be included as needed. Since such elements are generally known, their inclusion or omission is not deemed critical to the essential structure and functioning of the present invention in any of its embodiments.

Figure 3:
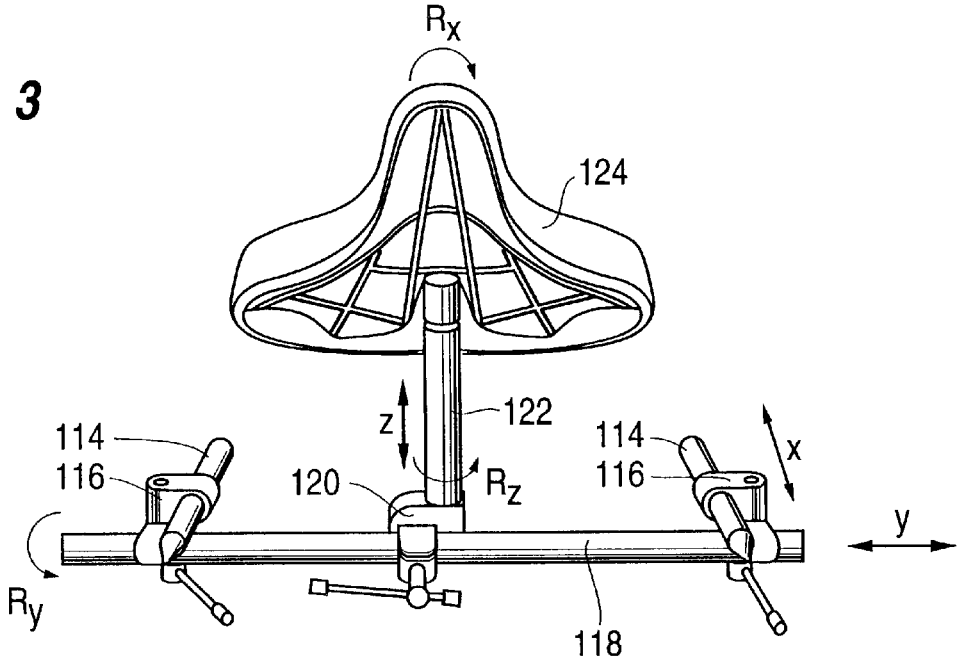
FIG. 3 is a front, upward-directed perspective view of principal elements for adjustably supporting an infinitely-adjustable seat element of the first embodiment per FIG. 2.

FIG. 3 is intended to clarify the previous discussion concerning the various translational and rotational degrees of freedom for adjusting seat 124 available with just the manner in which crossbar 118 is mounted to support bars 114, 114 and saddle seat 124 is mounted to crossbar 118. In FIG. 3, curved arrow $R_x$ is intended to indicate rotational freedom about the x-direction, curved arrow $R_y$ to indicate rotational freedom about the y-direction, and curved arrow $R_z$ to indicate rotational freedom about the z-direction, respectively.

Figure 4:
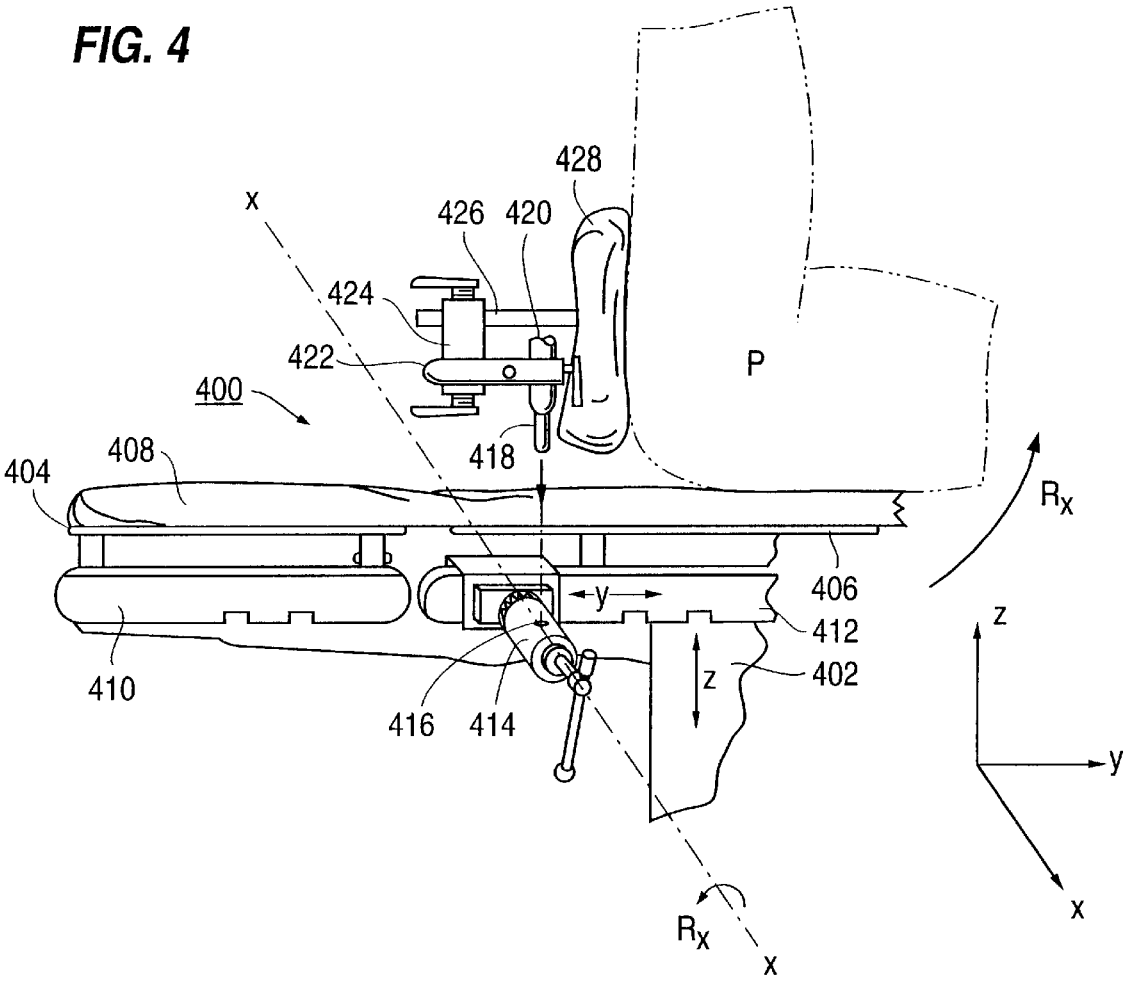
FIG. 4 is a partial side/perspective view of a second embodiment which includes a two-part support table arrangement adapted to provide infinitely adjustable support to a cooperating seat component.

FIG. 4 is a partial side view of a second preferred embodiment of this invention. This embodiment utilizes a combination which includes a different but known type of tiltable patient-supporting table/pad structure 400. This particular structure includes a vertical support element 402 which can be adjustably moved up or down along the Oz direction in any known manner, e.g., hydraulically, electrically, or mechanically, and supports a two-part table comprising cooperating upper table parts 404 and 406. When both table parts 404 and 406 are disposed horizontally their upper surfaces should be coplanar and will cooperate to provide a two-part support surface for a flexible patient-supporting pad 408 which may be placed thereon and affixed thereto in any known manner. However, for maximum versatility, one or both of table parts 404 and 406 may be mounted to be independently tiltable about a horizontal axis parallel to X—X as schematically indicated in FIG. 4. Again, as noted earlier, the exact manner in which the pivoting is provided, and how the tilting of the different elements about the respective pivots is obtained, controlled, and secured, details are not considered critical to the present invention. It is sufficient if at least one of the table parts, e.g., 406, is mounted to be pivotable about a horizontal axis parallel to X—X in any known manner so that it may experience rotational freedom corresponding to the curved arrow $R_x$ as schematically indicated in FIG. 4.

Underneath the forward table part 404, longitudinally disposed on opposite sides thereof, is a first pair of support bars 410, 410 (only one visible in the view in FIG. 4). Similarly, there is also provided a second pair of support bars 412, 412 mounted beneath table part 406. In the second embodiment per FIG. 4, each support bar 412 is slidingly passed through a portion of a corresponding first support clamp 414. There is, thus, a pair of such clamps 414, 414, although only one is visible in the view of FIG. 4. Each of these clamps 414 is provided with a through aperture 416 into which is slidable a lower end portion 418 of a corresponding mounting rod 420 an upper portion of which passes through and may be clamped to an intermediate clamp element 422. This intermediate clamp element 422, in cooperation with a counterpart on the other side of table part 406, supports a crossbar 424 which supports a seat post 426 to which is mounted a saddle seat 428 as indicated in FIG. 4.

Once again, it is emphasized that the individual clamps, support bars, support rods, saddle seat mounts, etc., are all essentially known elements and numerous choices for their forms and manners of clamping are readily available. The exact details of how these elements are shaped, tightened, adjusted, etc., are not considered critical to the present invention. What is important, however, is that any known patient support table system can be readily adapted with this invention to support a seat the patient-contacting portion whereof may be mounted just above the upper surface of patient-support pad 408 more or less inclined thereto, as shown generally in FIG. 4. Then, when table part 406 is tilted by rotation as indicated by curved arrow $R_x$, the patient P (indicated by chain lines) will have a tendency to slide toward seat 428 and will be restrained by a counter or reaction force provided by seat 428 opposing further sliding movement of patient P relative to pad 408. In other words, when table part 406 is tipped about a horizontal axis near its front, the upper trunk, shoulder and head portions of the patient will be lifted from the horizontal position, but the patient will not be able to slide further down the table because of contact with the adjustably positioned saddle seat 428. Bars 406, 406 will turn with table part 406. Saddle seat 428 will rotate, pivot or tip together with table part 406, and patient P will thereby be positioned so that a doctor standing between the patient's legs individually supported in a lithotomy position and forwardly of the patient's pelvis will be able to view and access the patient's epigastric region, i.e., the upper abdominal region, to perform surgery, examination, or other treatment.

Figure 5:
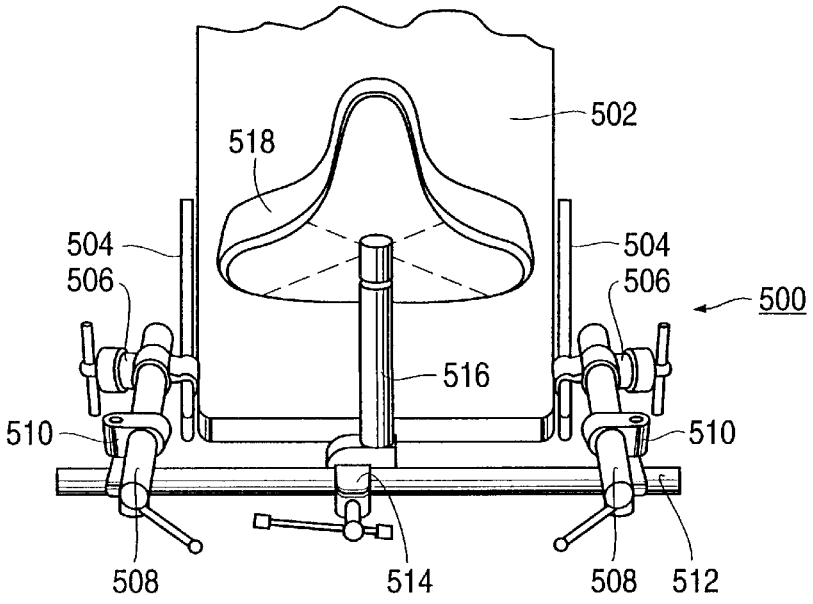
FIG. 5 is a front, upward-directed, partial perspective view of structure by which a saddle-seat component may be supported in cooperation with a tiltable table according to a third embodiment of the invention.

FIG. 5, in a partial perspective view, is intended to illustrate a modification of the above-described second preferred embodiment which includes only one pivotable table part (not shown) comparable to table part 406 of the second preferred embodiment per FIG. 4. In other words, in the embodiment per FIG. 5 there is entirely omitted a counterpart to the table part 404 of the second preferred embodiment. A suitably sized patient-support flexible pad 502, with or without an optional cover, may be affixed to the underlying table part (not shown) in any known manner. In this embodiment, there is provided a pair of cooperating support bars 504, 504 respectively disposed on opposite sides of pad 502 and mounted to the underlying table part.

To bars 504, 504 are slidably mounted clamps 506, 506, each of which slidably supports a corresponding support bar 508. There is, thus, a pair of support bars 508, 508 slidably mounted to support bars 504, 504. Obviously, support bars 508, 508 may be rotated relative to support bars 504, 504. Support bars 508, 508 cooperatively support a corresponding pair of clamps 510, 510 which together support a crossbar 512. To crossbar 512, by another clamp 514, is mounted a generally upright seat post 516. Finally, to the upper distal end portion of seat post 516 is mounted a saddle seat 518 much as in the first preferred embodiment per FIGS. 1–3. As with the first preferred embodiment, by this arrangement, saddle seat 518 is mounted cooperatively with and directly in front of patient-support pad 502 in a manner which permits its adjustment, by suitable loosening and subsequent tightening of various clamps, with all six degrees of freedom: three in translation and three in rotation, exactly as was provided in the first preferred embodiment. The only significant difference between the first and third preferred embodiments is that in the latter support rods 508, 508 are not mounted directly to the uppermost table portion underlying the patient support pad but are, instead, clamped to support bars 504, 504 instead. Note that unlike the arrangement in the second embodiment, support bars 504, 504 do not have to tip or tilt as the table part and pad 502 are inclined.

Figure 6:
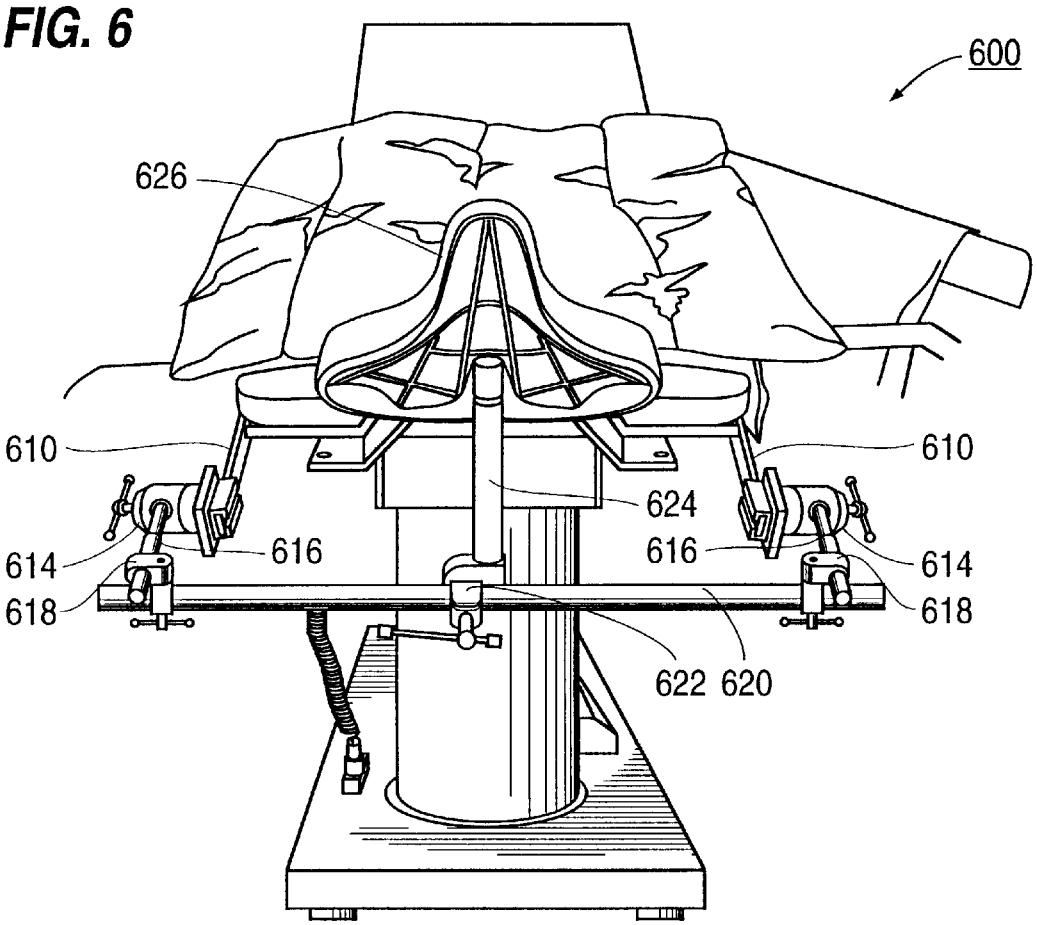
FIG. 6 is a front perspective view of the principal patient-supporting elements of the apparatus according to FIG. 4, with portions of the leg-supporting stirrups omitted.

FIG. 6 is generally similar to FIG. 2, but relates to the type of structure illustrated in FIG. 4 for the second preferred embodiment. In the third embodiment illustrated in FIG. 6, which is perhaps of a type more commonly employed by surgeons than is the first preferred embodiment per FIGS. 1–3, there is provided a pair of parallel rectangular cross-section, forwardly-extending rails or support bars 610, 610. To these are slidingly mounted clamps 614, 614 each supporting a respective preferably cylindrical forwardly-extending support bar 616, 616. To these, in turn, are supported clamps 618, 618 which cooperatively support a transverse seat-support bar 620. Bar 620 supports a slidable clamp 622 which, in turn, supports upward seat-support post 624 on top of which is mounted seat 626.

Figure 7:
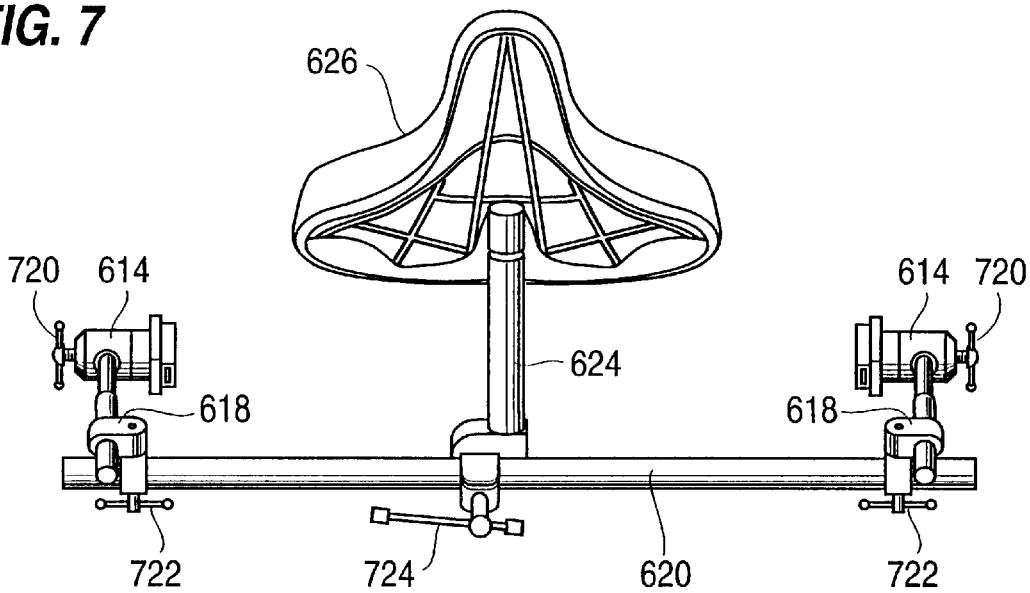
FIG. 7 is a front upward-directed perspective view of principal elements for adjustably supporting an infinitely-adjustable seat element of the second embodiment per FIG. 4.

FIG. 7, in similar manner, may be considered comparable to FIG. 3 and illustrates in somewhat enlarged form the above-discussed components cooperatively mountable to the pair of rails or support bars 610, 610 in the second preferred embodiment. As will be readily understood, each of the clamps is individually and independently tightenable to be secured in a selected location in translation and in a selected location in rotation by the use of known threaded elements and user-graspable end bars such as 720, 722 and 724, as best seen in FIG. 7. Other aspects and features of the second embodiment per FIGS. 6 and 7 can be readily understood, both in terms of function and manner of use, from the above detailed description of the first preferred embodiment.

Figure 8:
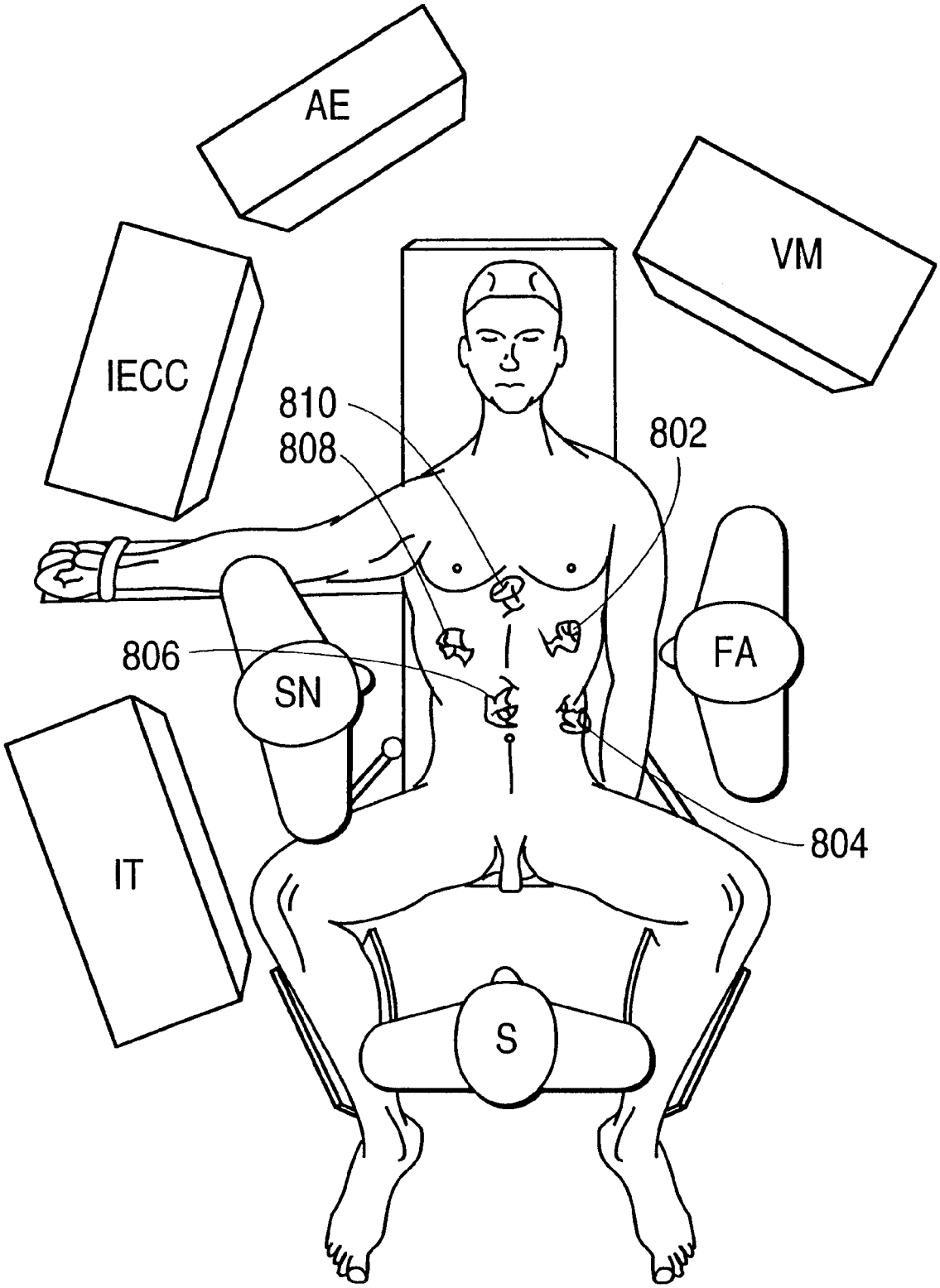
FIG. 8 is a schematic plan view of an exemplary disposition of a patient and attendant surgeon/staff for an operation of a type for which this invention may be beneficially utilized.

FIG. 8 is a schematic plan view to clarify how a patient may be disposed for the performance of operations by a surgeon and support staff in circumstances in which the present invention per any of its embodiments may be beneficially utilized. In FIG. 8, "AE" represents a console containing anesthesia equipment, "FA" is a suitable position for the first assistant to the surgeon, "IECC" is a console containing insufflator electric cutter coagulator of known type suitable for laparoscopic surgery, "IT" is a console/system supporting a surgical instrument tray for the surgeon's use, "S" is representative of the surgeon positioned between the patient's legs so as to be able to access the patient's epigastric region for surgery, "SN"0 is the scrub nurse in position to assist the surgeon, and "VM" is a conventional position for a video monitor by which a surgeon can see inner portions of the patient's epigastric region through the use of conventional optic fiber instrumentation introduced into the patient's epigastric region. Suitable entry portals for surgical procedures involving, for example, laparoscopic surgery to address acid reflux problems or the like, are indicated by the numerals 802, 804, 806, 808 and 810.

As persons skilled in the surgical arts will readily appreciate, for such surgical procedures it is important to support the patient securely in a disposition such that various laparoscopic instruments introduced via the above-identified entry portals can access the surgical site for viewing, physical manipulation, surgical operations such as incision, cauterization, or body fluid coagulation, and also for removal of excised tissues. Conventional surgical elements such as trocars, optical fiber viewing elements, and surgical tools introducable through lumens may thus be utilized in optimum manner. As discussed above, the improvement in patient-support available through use of the present invention does not significantly reduce access by the surgeon, because the seat providing the additional desired support under the patient's buttocks need not take up a significant amount of room between the patient and the surgeon. Use of this seat, however, greatly enhances the freedom of the surgeon to optimally position and operate on the patient.

As will be appreciated, the exact structural form of the seat 124, 518 or 626, e.g., a saddle form like that of a conventional bicycle seat, is a matter of choice for the manufacturer of the equipment and the surgeon, depending on who exercises the final judgment. What is most important is that the seat be adjustable in numerous degrees of freedom by the surgeon and/or his assistants, quickly and with virtually infinite variability, with the securing of each degree of freedom also being readily accomplished. The present invention, through the use of known types of components, e.g., clamps, support bars, etc., makes for relatively inexpensive and easy realization of these goals.

With any of the above-described embodiments, the procedure for suitably supporting a patient is generally the same. First, the patient-support pad (112, 408 or 502) is put in an essentially horizontal position and the patient placed thereon. At this time, the patient's torso/trunk, shoulders and head all lie in a generally horizontal position with most of the patient's weight acting vertically downward on the upper surface of the corresponding patient-support pad. In the first and third embodiments, the surgeon or one of his or her assistants, based on experience, will adjust, locate and secure by loosening and subsequent clamping of assorted clamps the seat 124 or 518 at a suitable height and at a suitable inclination in a position corresponding to the buttocks of the patient. Note that with these two embodiments the seat need not at this point be in actual contact with the patient's buttocks. However, in the second embodiment per FIG. 4, at this stage the seat preferably will be in contact with the patient's buttocks as the patient's thighs are raised to a substantially vertical position relative to the essentially horizontal patient-support pad 408.

In all of these embodiments, in the next stage, a doctor and any assistants must pivot or tip the patient-support pad and appropriate underlying elements so that the patient's upper torso, shoulder and head are raised above the patient's buttocks and pelvic region. In each case, particularly when a relatively low-friction pad or pad cover is provided directly beneath the patient's body, the patient's weight will cause the patient's body to slide until the patient's buttocks move into firm resisted contact with the corresponding seat. The process of tilting the patient may begin gradually and the doctor, with or without conscious cooperation by the patient, may further adjust the corresponding seat as deemed most appropriate. If patient leg-supporting stirrups 204, 204 are to be utilized, as may be done with any of the different embodiments, the patient's legs preferably will be placed in a lithotomy position and securely supported with stirrups. Eventually, when all clamps are finally tightened and the patient's arm is optionally supported to permit access by an anesthesiologist, the patient may be tilted to a severe reverse Trendelenberg position which presents optimal frontal access of the epigastric region to the surgeon.

The most important thing to appreciate is that by the provision of a very simple seat, mounted adjustably with all degrees of freedom available to the user for necessary adjustments, virtually any simple tiltable patient support table system can be easily made highly adaptable and versatile. This is particularly true for surgical activities in which the patient's epigastric region must be fully visible and accessible to a surgeon with the patient tipped in such a position that the patient's organs are correctly positioned. The present invention permits this to be done in a highly controlled and versatile manner as contrasted to the rather primitive bean-bag type of structure used and known in the current state of the art. The improvement to the system provided by the present invention, i.e., the inclusion of a highly adjustable and correctly positionable saddle-seat mechanism, can thus be used to upgrade, retrofit, and render more adaptable a variety of existing tiltable-table type patient support systems. The various elements are extremely simple to use and are relatively inexpensive, the clamps can be of any simple type readily adjustable by hand without undue exertion, the seat may be readily provided with a sterile disposable cover for each patient, and all the hardware elements may be made of suitable metal, e.g., stainless steel, so that they may be sterilized in any conventional manner as needed.

Note that in all of the above-described embodiments the seat has been shown as having a wider rear portion closest to the corresponding table and pad, and a relatively narrow front portion facing forward. This front portion does not, of course, have to be long as is generally the case with bicycle seats. Note also that various adjustments to alter the position of the seat may be made independently of each other.

Obvious modifications and variations of the above-described structure and the manner of its use will no doubt occur to persons of ordinary skill in the art. All such obvious modifications and variations are intended to be comprehended within the present invention which is limited solely by the claims appended below.

What is claimed is:

1. Apparatus for supporting a patient in an inclined position comprising:

a base;

a support table movably mounted to the base so as to be adjustable at least vertically and inclinable about a first axis of rotation relative to the base, for supporting at least head and back portions of the patient; and a seat having a rear end portion disposed adjacent a front end of the support table and a front portion disposed forwardly thereof, mounted to the base by means for adjustably supporting the seat so that the seat is selectively adjustable independently of the support table, horizontally, laterally, vertically, and rotationally at least about a second axis of rotation relative to the base, so that the rear portion of the seat extends beneath and supports the patient's buttocks when the table is inclined.

2. The apparatus according to claim 1, further comprising:

stirrup extensions supported to the base and adjustable relative to the support table to support respective legs of the patient.

3. The apparatus according to claim 1, further comprising:

at least one adjustable arm support member supported to the base to support a corresponding arm of the patient.

4. The apparatus according to claim 1, wherein:

the base comprises a lower portion, an intermediate portion supported by the lower portion, and an upper portion supported by the intermediate portion and movable relative thereto, the support table being mounted to the upper portion.

5. The apparatus according to claim 1, further comprising:

a pair of leg stirrups adjustably supported above the base to support the patient's legs.

6. The apparatus according to claim 4, wherein:

the seat support means is mounted to the upper portion.

7. The apparatus according to claim 4, wherein:

the seat suppport means includes a pair of parallel support rods extending along and on opposite sides of the support table, a crossbar slidably supported by the pair of support bars and clampable thereto, a seat post slidably and rotatably supported to the crossbar and clampable thereto, and an adjustable connection connecting the seat to an upper end portion of the seat post.

8. The apparatus according to claim 7, further comprising:

known means for controllably adjusting a height of the upper portion of the base relative to the intermediate and lower portions thereof.

9. An improved surgical support system for supporting a patient in an adjustably inclined position above a base, with the patient's torso and head supported on an inclinable table supported at a selected height above the base, wherein the improvement comprises:

means for adjustably supporting a seat to the base; and a seat supported to the base by said means, having a rear end portion disposed adjacent a front end of the table to support the patient's buttocks, wherein the seat is adjustable in translation and is rotatable about at least one axis relative to the base.

10. The improved apparatus according to claim 9, further comprising:

a pair of leg stirrups adjustably supported above the base to support the patient's legs.

11. The improved apparatus according to claim 10, further comprising:

at least one adjustable arm rest for supporting an arm of the patient.

12. A method of supporting a patient so as to facilitate frontal access by a doctor to the epigastric region of the patient, comprising the steps of:

placing the patient on an inclinable table extending beneath and supporting the back of the patient;

inclining the table; and providing and adjusting a seat independently of the table in both translation and rotation to support the patient's buttocks in cooperation with the inclined table.

13. The method according to claim 12, comprising the further step of:

supporting the patient's legs on opposite sides of the seat in such a manner that the patient's pelvic region is located above a narrow forward end portion of the seat and is thereby accessible to a doctor located in front of the patient's pelvis.

14. The method according to claim 12, comprising the further step of:

supporting at least one arm of the patient laterally of the patient's torso.

15. The method according to claim 12, wherein:

the patient's head is also supported to the table.

16. The method according to claim 12, comprising the further step of:

providing a pad between the table and the patient.

17. The method according to claim 16, comprising the further step of:

providing a cover on the pad.

* * * * *